US006764341B2

(12) United States Patent
Lappoehn

(10) Patent No.: US 6,764,341 B2
(45) Date of Patent: Jul. 20, 2004

(54) PLUG CONNECTOR THAT CAN BE TURNED BY 90°

(75) Inventor: Jürgen Lappoehn, Gammelshausen (DE)

(73) Assignee: Erni Elektroapparate GmbH, Adelberg (DE)

( * ) Notice: Subject to any disclaimer, the term of this patent is extended or adjusted under 35 U.S.C. 154(b) by 139 days.

(21) Appl. No.: 10/155,859

(22) Filed: May 24, 2002

(65) Prior Publication Data

US 2003/0008561 A1 Jan. 9, 2003

(30) Foreign Application Priority Data

May 25, 2001 (DE) ..... 101 25 855
Oct. 26, 2001 (DE) ..... 101 52 439

(51) Int. Cl.[7] ..... H01R 13/648
(52) U.S. Cl. ..... 439/608; 439/609
(58) Field of Search ..... 439/608, 609, 439/701

(56) References Cited

U.S. PATENT DOCUMENTS 5,620,340 A * 4/1997 Andrews ..... 439/608
6,129,555 A * 10/2000 Daikuhara et al. ..... 439/60
6,247,970 B1 * 6/2001 Ueno et al. ..... 439/608
6,471,549 B1 * 10/2002 Lappohn ..... 439/608
2002/0086582 A1 * 7/2002 Nitta et al. ..... 439/608
2003/0022555 A1 * 1/2003 Vicich et al. ..... 439/608

FOREIGN PATENT DOCUMENTS

DE 100 51 818 10/2000

* cited by examiner

*Primary Examiner*—Hae Moon Hyeon
(74) *Attorney, Agent, or Firm*—Collard & Roe, P.C.

(57) ABSTRACT

The invention relates to a plug connection with shielding, preferably comprising a male multipoint connector and female multipoint connector, with a plurality of contact elements (4; 41), which are provided at least in pairs with shieldings in the form of shield plates (3; 31). The contact elements (4; 41) are disposed in a plurality of parallel rows. The shield plates (3; 31) embrace two or more contact elements (4; 41) of at least two rows (5*a*, 5*b*, 5*c*, 5*d*). Thus two plug connectors can be connected to one another at an angle of 90° relative to one another, or can be pushed from two sides onto a printed-circuit board (6).

11 Claims, 7 Drawing Sheets

PLUG CONNECTOR THAT CAN BE TURNED BY 90°

BACKGROUND OF THE INVENTION

1. Field of the Invention

The invention relates to a plug connector with integrated shielding, for electrical contacting preferably of multi-conductor cables with one another or with a printed-circuit board or the like. Preferably the plug connector comprises a male multipoint connector and corresponding female multipoint connector, which can be connected detachably to one another.

2. The Prior Art

From German Patent DE 10051819 A1 of the Applicant, there is known a plug connection with shielding, wherein both the male multipoint connectors and the female multipoint connectors are provided with shield plates. These shield plates ensure that the electrical connection of the blades and sockets is shielded from external electromagnetic interfering influences and that crosstalk from one electrical contact to the other is prevented. In this plug connection the individual contacts of the multi-conductor male and female multipoint connectors are disposed in a plurality of rows parallel to one another.

To transmit electrical signals or a supply voltage, it is often necessary to gather two or more electrical contacts of the plug connector together in pairs or groups and to provide them with shielding. For this purpose, the respective shield plates on male and female multipoint connectors are configured in such a way that they comprise a substantially continuous perimeter that embraces at least two electrical connections, preferably in the form of pairs or groups of blades and sockets, and shield them from the outside.

With such a plug connection, however, the orientation of the two elements of the plug connection relative to one another is predetermined. By virtue of the configuration of the shield plates, pairwise shielding of two adjacent contact elements in a row is possible only if the two elements are inserted one inside the other in correct position relative to one another or, for example, if two multipoint male connectors are pushed from two sides onto a printed-circuit board, wiring board or the like.

In many cases, however, it is desired that the two plug connector elements be pushed onto a printed-circuit board from two sides at an angle of 90° relative to one another. Thereby continuous and at least pairwise shielding of two contact elements is not possible with the known plug connectors.

SUMMARY OF THE INVENTION

Starting from the prior art, the person skilled in the art is faced with the object of configuring a plug connector in such a way that the two plug-connection elements are offset at an angle of 90° relative to one another as viewed in their respective longitudinal extents, that they can be connected to one another or can be pushed from two sides onto a printed-circuit board, and that shielding of the contact elements in pairs or groups is possible; an alternative object is to make the plug connector compatible with standardized components.

A central idea of the invention is that the contact elements, or in other words the blades or sockets of the respective plug-connection element, disposed in a plurality of rows parallel to one another, are disposed such that they are offset relative to one another. This means that at least two of the plurality of rows of the contact element are disposed relative to one another at gaps or are offset relative to one another in the plug-connection element. In a projection perpendicular to the longitudinal direction of the respective row, therefore, the contact elements of at least two of the rows are not located directly one above the other. Furthermore, the shield plates are configured such that at least two contact elements, each from respectively one row, are jacketed in pairs or groups substantially by shielding technology. In this case the shielding can surround two contact elements from two adjacent rows or a plurality of contact elements from a plurality of adjacent rows. Preferably the contact elements are shielded respectively in pairs. The respective shield plates of the multipoint male and female connectors are then designed such that, in the assembled condition of the plug connector or when it is pushed onto a printed-circuit board from two sides, the shielding forms a continuous perimeter around the two or around the plurality of contact elements.

By virtue of the arrangement of rows of contact elements offset relative to one another as well as the shielding which extends over a plurality of rows, it is ensured that the two plug-connector elements, while being offset at an angle of, for example, 90° relative to one another as viewed in their respective longitudinal directions, can be connected to one another. Seen in horizontal projection, these contact elements preferably have a square arrangement relative to one another, so that the plug connectors, again viewed over their longitudinal extent, can be connected to one another at different respective positions. Nevertheless, by virtue of the arrangement of the shield plates, continuous shielding of at least two contact elements from the outside or from external interfering influences is possible.

In principle, a plurality of further plug connectors turned by 90° can be disposed on a plug connector or on a plug connector pushed onto a printed-circuit board.

Preferably the plurality of rows of the contact elements in the respective plug-connector elements is arranged in such a way that two groups of rows are formed. The first group and the second group respectively are arranged in such a way that, in a projection perpendicular to their longitudinal extent, the individual contact elements are disposed one over the other. The first and second groups of the rows, however, are offset relative to one another.

With an even number of rows, especially four, it is possible to achieve a symmetric construction of the plug-connector element, and so, in the connection of two plug-connection elements at an angle of 90° relative to one another, all contact elements of the plurality of rows can be connected to one another.

In an advantageous improvement of the invention, the respective shield plates are disposed at an angle of 45° to the longitudinal extent of the rows of contact elements. In this case they embrace at least two contact elements of two adjacent rows. In this way it is also ensured that all contact elements of the plurality of rows are surrounded in pairs or groups by shield plates. In another improvement of the invention, the shield plates are substantially U-shaped. With appropriate dimensioning of the shield plate as well as of the spacings of the rows and of the individual contact elements relative to one another, the action of inserting the two plug-connector elements one into the other ensures that the respective limb of the adjacent U-shaped shield plate forms, together with the rear side of the first shield plate, a shielding comprising a substantially continuous perimeter around at least two contact elements.

In a further, second, equally important core idea of the invention, according to which the two plug-connection elements are also offset at an angle of 90° relative to one another as viewed in their respective longitudinal extents, can be connected to one another or can be pushed from two sides onto a printed-circuit board, it is on the one hand possible, by giving the contact elements, or in other words the electrically conductive pins, a crank-shaped structure, for the arrangement of the contact elements in straight rows to be positioned in alignment with one another and to be made compatible with conventional plug connectors, while on the other hand the crank-shaped structure of the contact elements, or in other words the substantially Z-shaped configuration of the metal pins, ensures that the outwardly directed or projecting third portions of the contact elements, viewed in longitudinal direction of the contact elements, are arranged so as to be offset relative to the first portions of the contact elements, which are disposed in parallel rows in alignment with one another. Thus these third portions, viewed in axial longitudinal extent of the contact elements, are offset sideways relative to the first portions.

The offset, which among other factors is determined by the size or length of the second portion, which extends substantially perpendicular to the longitudinal extent of the contact element, is preferably selected in conformity with the standardized plug-connector systems.

With the offset arrangement, as viewed in longitudinal direction of the contact elements, of the third portions relative to the first portions, it is ensured that the respective third portions, disposed in offset relationship, of two identically constructed male multipoint connectors can be pushed from two sides onto a wiring board provided with openings, as already mentioned hereinabove, so that the respective third portions touch approximately in the center plane of the wiring board and in this way an electrical connection is established between the contact elements of the male multipoint connectors. The inside wall of the openings can itself be designed to be electrically conductive, so that the tolerances for manufacture of the contact elements themselves do not have to be kept as narrow as for insertion of the contact elements into the said wiring board, thus permitting lower costs.

According to an advantageous improvement of this version of the invention, the orientation of the three portions of the contact elements is such that the first and third portions are oriented parallel to one another in their respective longitudinal extents, and the second portions, which form the actual crank-shaped structure, are oriented perpendicular thereto. In a special cost-saving manner, such crank-shaped contact elements can be made from straight contact elements or metal pins known in themselves by two bonding processes, which are preferably carried out simultaneously.

Advantageously the shield plates here also are formed substantially as U-shaped components, wherein the two parallel limbs of the "U" have respectively the same or different lengths. In particular, two first portions of two contact elements disposed next to one another in parallel rows are then embraced together by the U-shaped shield plate.

For this purpose it is advantageous that an even number of rows of contact elements be present, so that two adjacent contact elements are provided in each case with a common shield plate. Preferably four rows of contact elements are disposed in the male or female multipoint connector.

The male or female multipoint connectors are preferably made of plastic, usually by the injection-molding technique, the respective contact element either being insertable as a detachable component that can be locked by a snap connection or already being potted during manufacture.

The shield plates are obtained, for example, by bending over a flat metal sheet or cutting a profiled sheet to length, and also are either insertable detachably or already potted in the plug-connector element.

The U-shaped shield plates, in the form of bent over or angled metal sheets, can also pass through the bottom of a male multi point connector, so that on the other side they project above the face of the bottom. During manufacture of a male multipoint connector from plastic, for example, this can be achieved automatically in an injection-molding process.

In order to push the male multipoint connectors into correct position on a wiring board and thus in particular to avoid warping of the offset third portions of the further versions, there are provided further guide elements projecting outwardly beyond the bottom face of the male multipoint connector. These are preferably molded integrally onto the male multipoint connector, and therefore, for example, are formed during injection molding.

The rear side of a component facing the respective other plug-connector element is formed in such a way either that a further male or female multipoint connector can be connected to the element or that a four-conductor cable can be connected directly to the element.

BRIEF DESCRIPTION OF THE DRAWINGS

Further particulars, features and advantages of the invention will be demonstrated and explained in more detail in the following description section with reference to preferred practical examples illustrated schematically in the drawings, wherein.

DETAILED DESCRIPTION OF PREFERRED EMBODIMENTS

Figure 1:
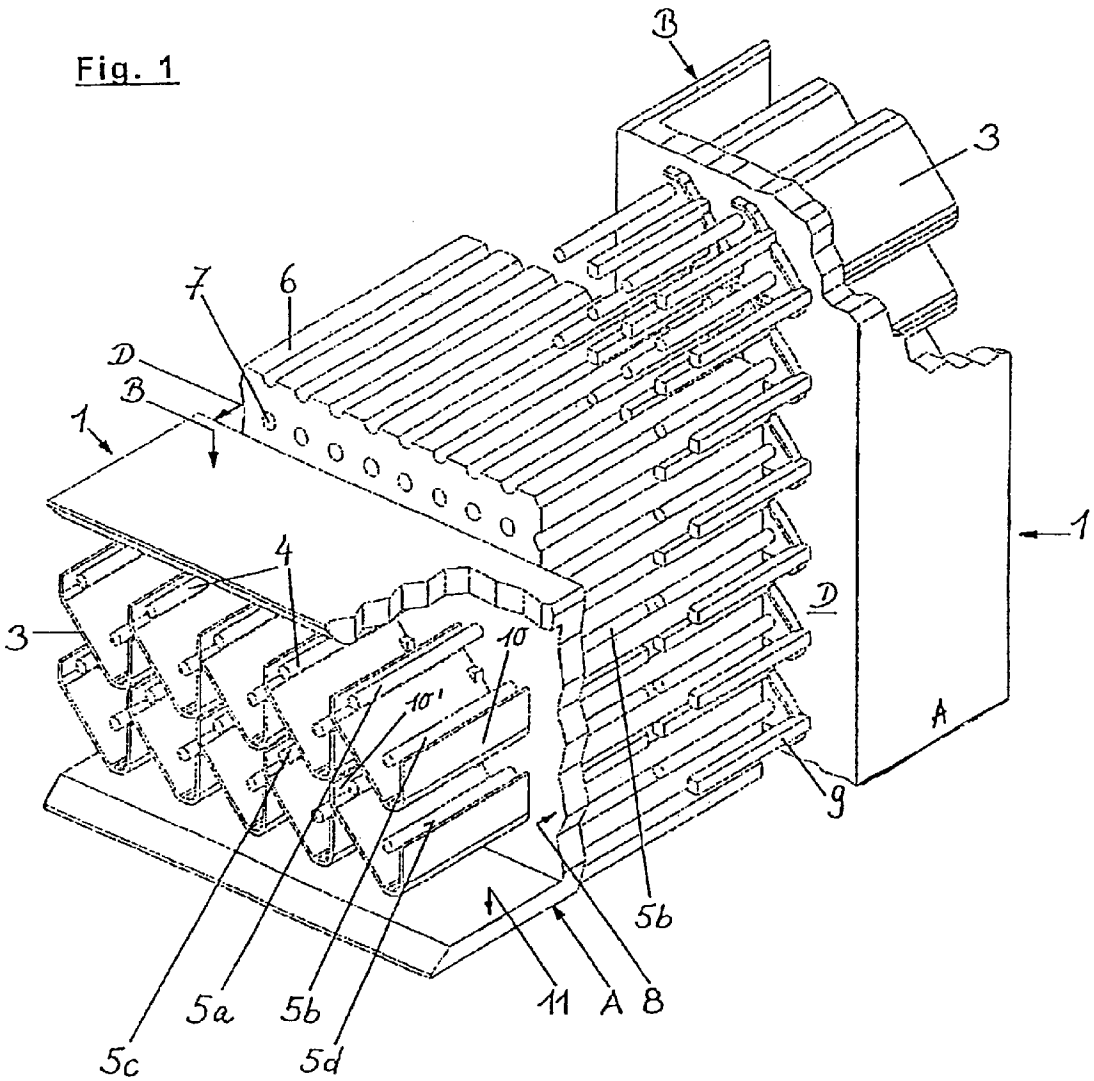
FIG. 1: shows a perspective diagram of two male multipoint connectors for plug connectors, pushed at an angle of 90° onto a printed-circuit board.

In the first practical example of the invention illustrated in FIG. 1, two male multipoint connectors 1 are pushed from two sides onto a printed circuit board 6. The two male multipoint connectors 1 are disposed at an angle of 90° relative to one another as viewed in their respective longitudinal directions. The two male multipoint connectors 1 are equipped with contact elements 4. These have the form of electrically conductive pins, which pass through bottom 8 of male multipoint connector 1. Together with side walls "A" and "B" there is defined an interior cavity into which there can be inserted a female multipoint connector of corresponding shape, with contact elements in the form of sockets. For better clarity of the drawings, the known female multipoint connector is not illustrated here.

In this case contact elements 4 are disposed in four rows 5*a*, 5*b*, 5*c*, 5*d* parallel to one another. In each two of these rows 5*a* to 5*d*, one is offset relative to the another, in such a way that, in projection perpendicular to the longitudinal direction, contact elements 4 of first and third rows 5*a* and 5*c* are disposed one above the other, as are second rows 5*b* and 5*d*. Each shield plate 3 embraces two contact elements 4 of two adjacent rows, either of rows 5*a* and 5*b* or of rows 5*c* and 5*d* in this case. These shield plates 3 are disposed at an angle of 45° relative to the longitudinal extent of rows 5*a*, 5*b*, 5*c* and 5*d*.

Shield plates 3 are substantially U-shaped, although the two limbs 10 and 10' of the "U" are not oriented perpendicular to the base of the "U" but instead are disposed perpendicular to the longitudinal extent of rows 5*a*, 5*b*, 5*c* and 5*d*.

In the horizontal projection onto male multipoint connector 1, therefore, the one limb 10 of the "U" is longer, such that it extends approximately to the adjacent row, specifically in such a way that, for example, in a shield plate 3 which embraces one contact element 4 of each of rows 5*a* and 5*b*, the longer limb of U-shaped shield plate 3 embraces contact pin 4 disposed in row 5*b*.

The female multipoint connector is provided with corresponding shield plates so that, when the female multipoint connector is inserted into male multipoint connector 1, contact elements 4 are enclosed in pairs by a shield plate 3 of male multipoint connector 1 and a shield plate of the female multipoint connector, which together form a substantially continuous perimeter.

Printed-circuit board 6 is provided with bores 7 to receive contact elements 4, the thickness of printed-circuit board 6 and the length of contact elements 4 preferably being selected such that male multipoint connectors 1 can be pushed from two sides onto printed-circuit board 6 and the respective contact elements 4 touch or bear against one another approximately in the center plane of printed-circuit board 6, thus establishing the electrically conductive connection; of course, bores 7 can also be provided with an electrically conductive coat.

The two male multipoint connectors 1 are offset at an angle of 90° relative to one another, so that in each case only that one of the number of contact elements 4 which corresponds to the number of rows 5*a*, 5*b*, 5*c* and 5*d* of the other male multipoint connector 1 can be contacted with one another. On side "D" of bottom 8 of male multipoint connector 1 facing printed-circuit board 6 there can also be molded, preferably integrally, further elements 9, which are used to guide and/or orient male multipoint connectors 1 and which are engaged in corresponding openings or bores in printed-circuit board 6. When male multipoint connector 1 is pushed onto printed-circuit board 6, guide pins 9 are introduced first and thus male multipoint connector 1 is oriented in correct position, so that warping of contact elements 4 is at least almost prevented.

Shield plates 3 can also be arranged in such a way that they pass through bottom 8 of male multipoint connector 1 and, in pushed-on condition, extend at least partly into printed-circuit board 6. In this way at least partial shielding of the electrical connection in the interior of printed-circuit board 6 is achieved. Appropriate grooves or recesses can be provided in printed-circuit board 6 to receive shield plates 3 projecting beyond bottom 8.

Figure 2:
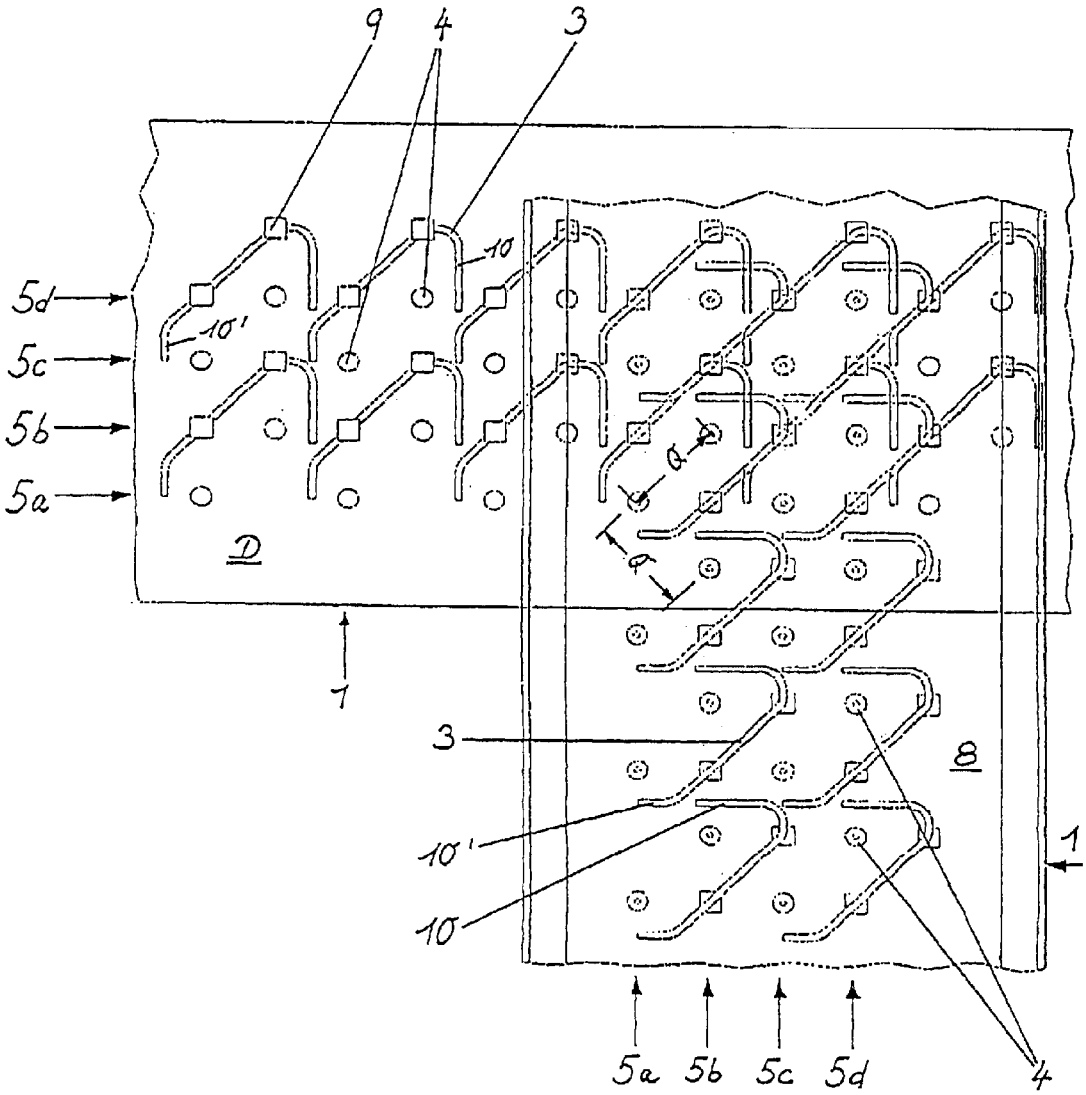
FIG. 2: shows a schematic diagram of two male multipoint connectors according to FIG. 1 in horizontal projection.

FIG. 2 illustrates a schematic projection of two male multipoint connectors 1 in the condition in which they are pushed onto a printed-circuit board 6, not illustrated here. In this case contact elements 4 are arranged in four rows 5*a*, 5*b*, 5*c* and 5*d* respectively, which are offset relative to one another. In addition, guide pins 9, preferably with square cross section, are also provided here.

Contact elements 4, which in this case are the blades of male multipoint connector 1, but which can also be the sockets of a female multipoint connector, are arranged in such a way that their mutual spacings "Q" are equally large both in respective rows 5*a*, 5*b*, . . . and between rows 5*a*, 5*b*, . . . In this way a square diagonal size of the contact elements is achieved. Contact elements 4 are embraced in pairs by a substantially U-shaped shield plate 3, whose limbs 10, 10' are oriented perpendicular to the longitudinal extent of rows 5*a*, 5*b*, 5*c*, 5*d*, limb 10 being longer than limb 10'. In the horizontal projection it is therefore evident that shielding of the electrical contacting is achieved over the longitudinal extent of the electrical contacting between the two male multipoint connectors 1 in a way which indeed does not pass physically through printed-circuit board 6 but technically has the effect of a perimeter.

Figure 2A:
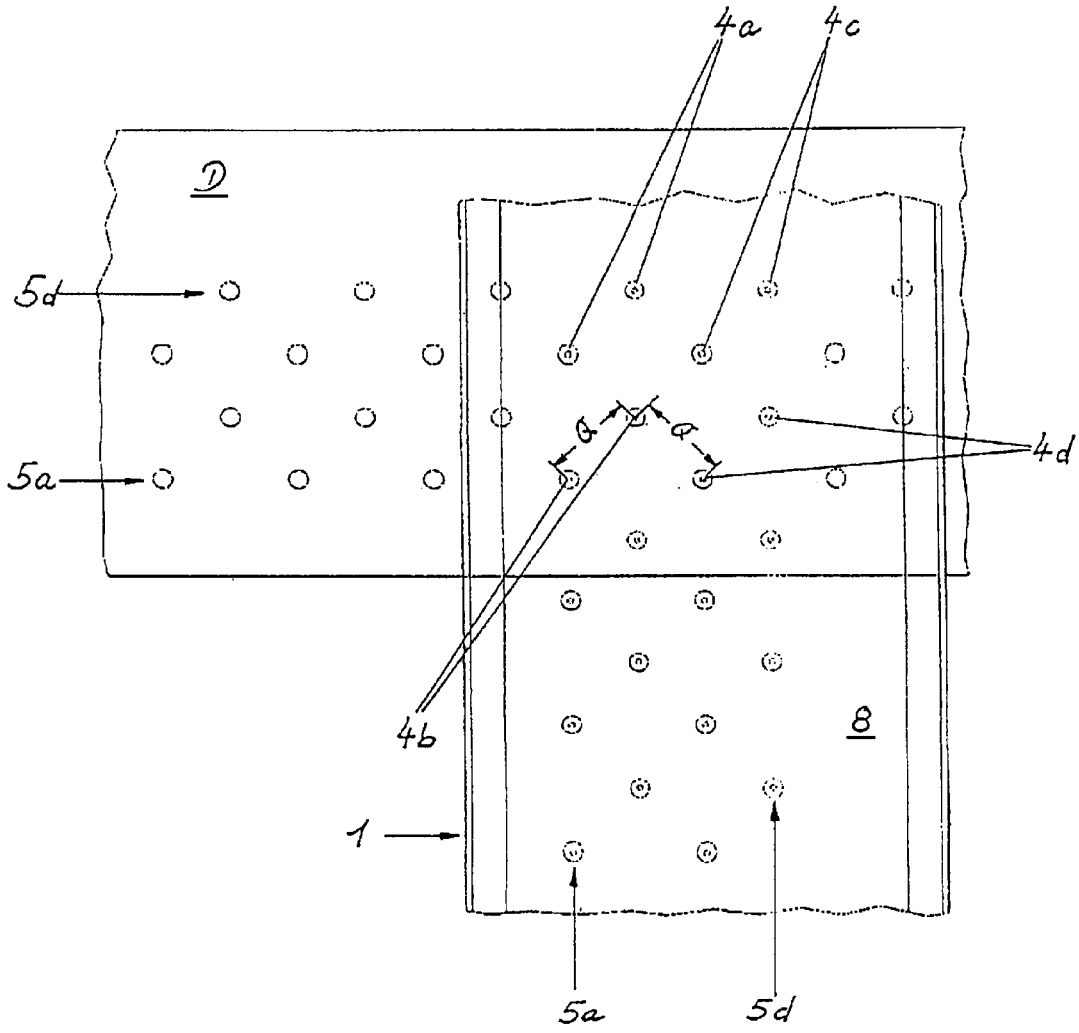
FIGS. 2*a* and 2*b*: show partial diagrams of FIG. 2.

FIG. 2*a* shows the arrangement of male multipoint connectors according to the diagram in FIG. 2, except that, for better clarity, the shield plates are not shown here, in order to illustrate the size of spacing "Q" between two contact elements of a pair of contact elements.

Figure 2B:
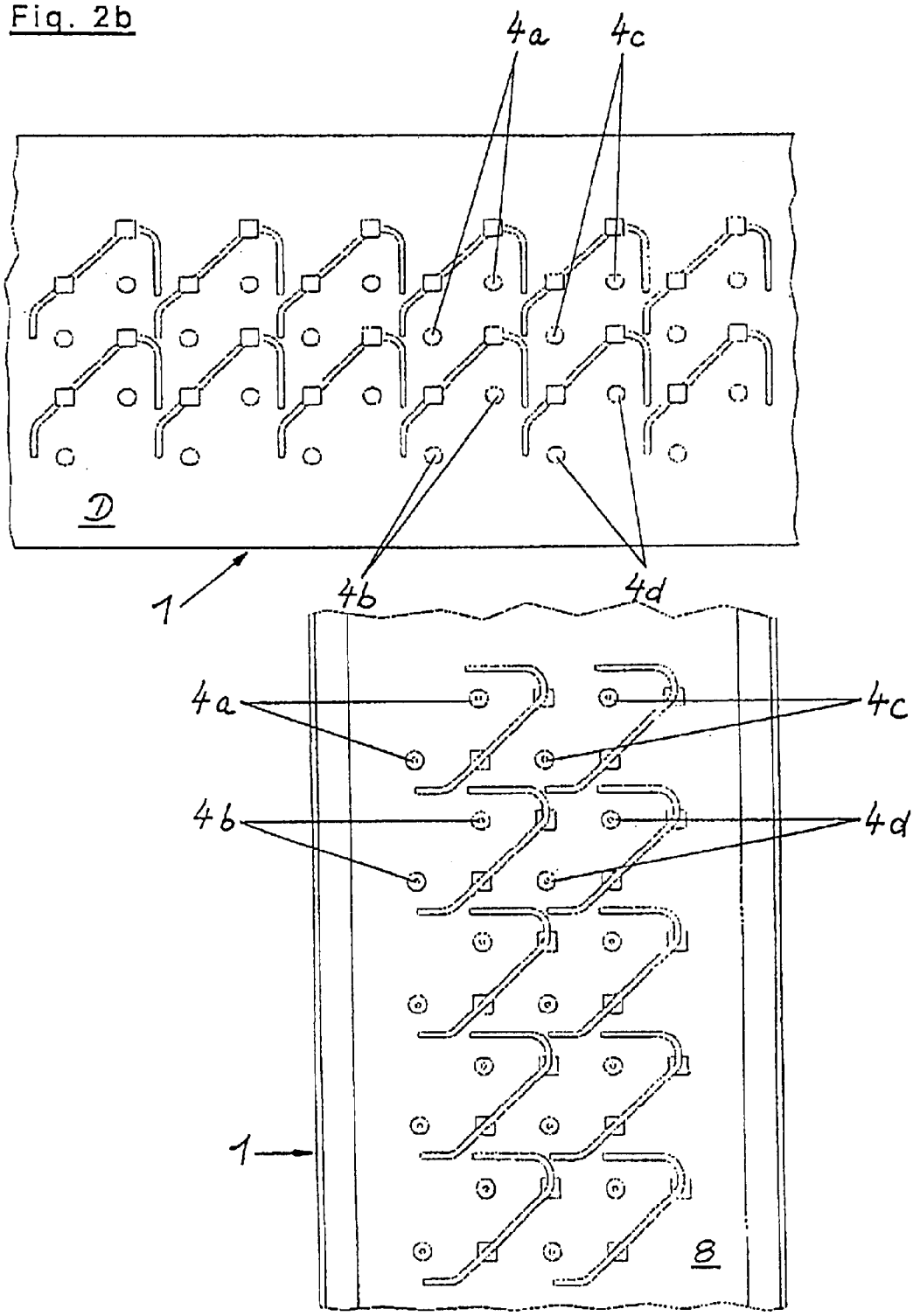

In FIG. 2*b* the two male multipoint connectors 1 shown in FIG. 2 as turned by 90° relative to one another, with their outer faces "D" of bottoms 8 facing one another, are separated sufficiently that they are not disposed one above the other, thus illustrating the location of the contact elements and of the shield plates. Outer face "D" of bottom 8 of one male multipoint connector is visible, while for male multipoint connector 1 shown at the bottom of this figure there is provided a view of the inner face of bottom 8 of male multipoint connector 1. In both male multipoint connectors 1, the pairs of contact elements disposed one above the other in FIG. 2 and connected to one another by circuit technology are indicated with the same reference symbols, specifically with reference symbols 4*a* to 4*d*.

Thus, with a female multipoint connector of corresponding structure, inserted into the interior cavity formed in male multipoint connector 1 by bottom 8 and the walls, for example, there is also achieved continuous shielding of the electrical connection between contact elements 4, such as blades, and the contact elements on the female multipoint connector, such as sockets.

Figure 3:
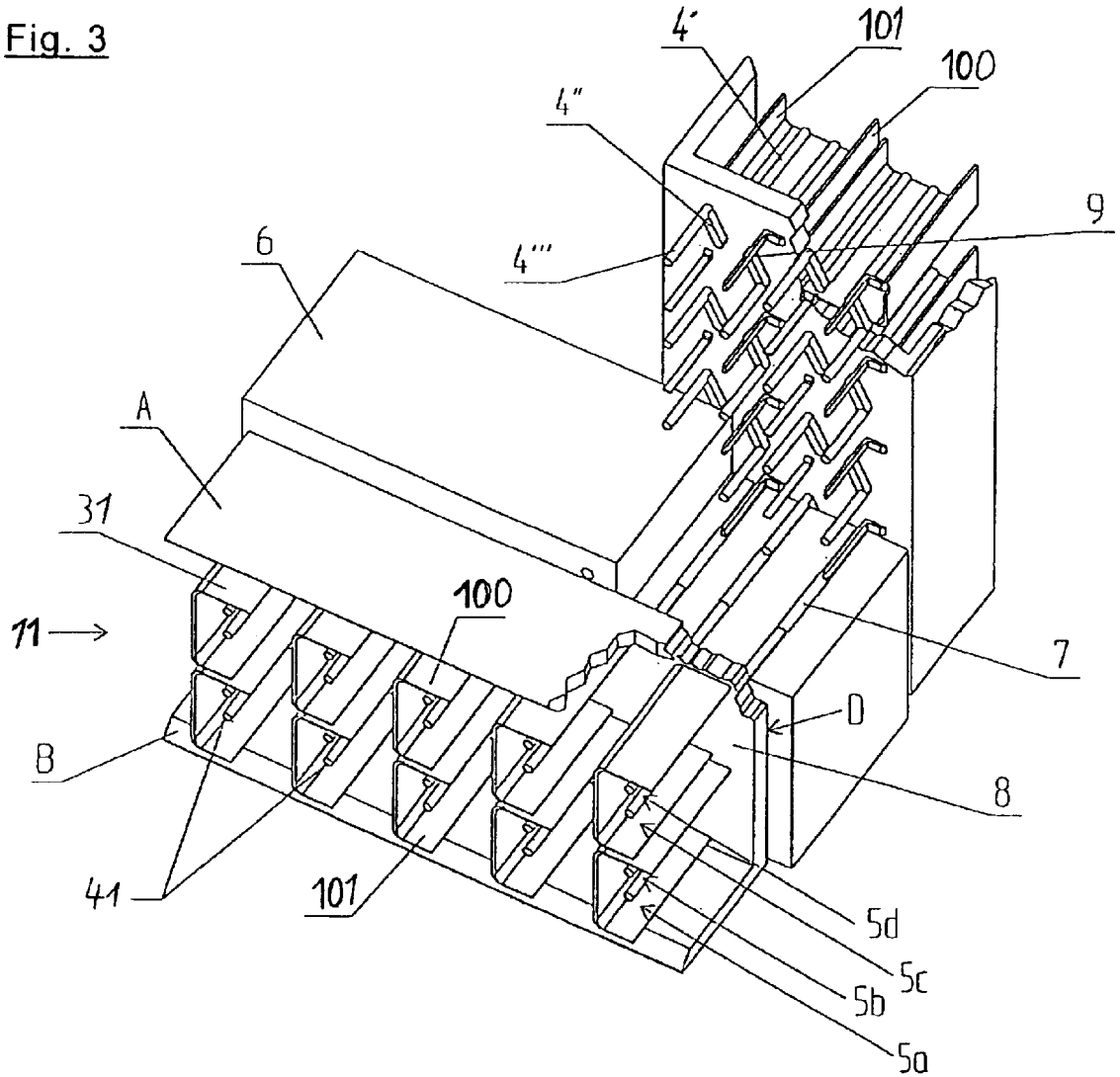
FIG. 3: shows a perspective diagram of two male multipoint connectors for plug connectors, pushed at an angle of 90° onto a printed-circuit board and provided with crank-shaped contact elements.

In the further practical example of the invention illustrated in FIG. 3, two male multipoint connectors 11 are pushed from two sides onto a printed-circuit board 6, just as in FIG. 1. The two male multipoint connectors 11 are equipped with contact elements 41. In this case these have the form of electrically conductive pins, which also pass through bottom 8 of male multipoint connector 11. Together with side walls "A" and "B" there is defined an interior cavity, into which there can be inserted a standardized female multipoint connector of corresponding shape, having contact elements in the form of sockets. For simplicity of the illustration, this female multipoint connector is once again not shown here.

In this case crank-shaped contact elements 41 are disposed in four rows 5*a*, 5*b*, 5*c* and 5*d* that are parallel to one another. These four rows 5*a* to 5*d* are arranged in alignment with one another, so that, in a projection perpendicular to the longitudinal direction, the respective first portions 4' of contact elements 41 of the four rows 5*a* to 5*d* are disposed one above the other.

Shield plates 31 each embrace two first portions 4' of contact elements 41 of two adjacent rows, either of rows 5*a* and 5*b* or of rows 5*c* and 5*d*. The base of shield plate 31 in this case is disposed at an angle of 90° relative to the longitudinal extent of rows 5*a* to 5*d*.

Shield plates 31 have substantially U-shaped structure, wherein the two limbs 100 and 101 of the "U" are oriented substantially perpendicular to the base of the "U" and are disposed parallel to the longitudinal extent of rows 5*a* to 5*d*. The two limbs 100 and 101 in FIG. 3 have different lengths.

The female multipoint connector, which is not illustrated here, is equipped with corresponding shield plates so that, when the female multipoint connector is inserted into male multipoint connector 11, first portions 4' of contact elements 41 are enclosed in pairs by a shield plate 31 of male multipoint connector 11 and a shield plate of the female multipoint connector, which together form a substantially continuous perimeter, and thus are shielded against external electrical interfering influences as well as being shielded from the outside.

Printed-circuit board 6 is provided with bores 7 to receive third portions 4''' of contact elements 41, the thickness of printed-circuit board 6 or the length of third portions 4''' of contact elements 41 preferably being chosen such that male multipoint connectors 11 can be pushed from two sides onto printed-circuit board 6 and the respective third portions 4''' of contact elements 41 touch or bear against one another approximately in the center plane of printed-circuit board 6, thus establishing the electrically conductive connection. Of course, bores 7 can also be provided with an electrically conductive coating or can be embedded in the form of metal sockets in a plastic printed-circuit board 6.

The two male multipoint connectors 11 are turned at an angle of 90° relative to one another, so that in each case only a number of contact elements 41 which corresponds to the number of rows 5*a* to 5*d* of the other male multipoint connector 11 can be contacted with one another. On side "D" of bottom 8 of male multipoint connector 11 facing printed-circuit board 6 there can also be molded, preferably integrally, further elements 9, which are used to guide and/or orient male multipoint connectors 1 and which are engaged in corresponding openings or bores in printed-circuit board 6. When male multipoint connector 11 is pushed onto printed-circuit board 6, guide pins 9 are introduced first and thus male multipoint connector 11 is oriented in correct position, so that warping of third portions 4''' of contact elements 41 is at least almost prevented.

Shield plates 31 provided here can also be arranged in such a way that they pass through bottom 8 of male multipoint connector 11 and, in pushed-on condition, extend at least partly into printed-circuit board 6. In this way at least partial raised shielding of the electrical connection in the interior of printed-circuit board 6 is achieved. Appropriate grooves or recesses can be provided in printed-circuit board 6 to receive shield plates 31 projecting beyond bottom 8.

Figure 4:
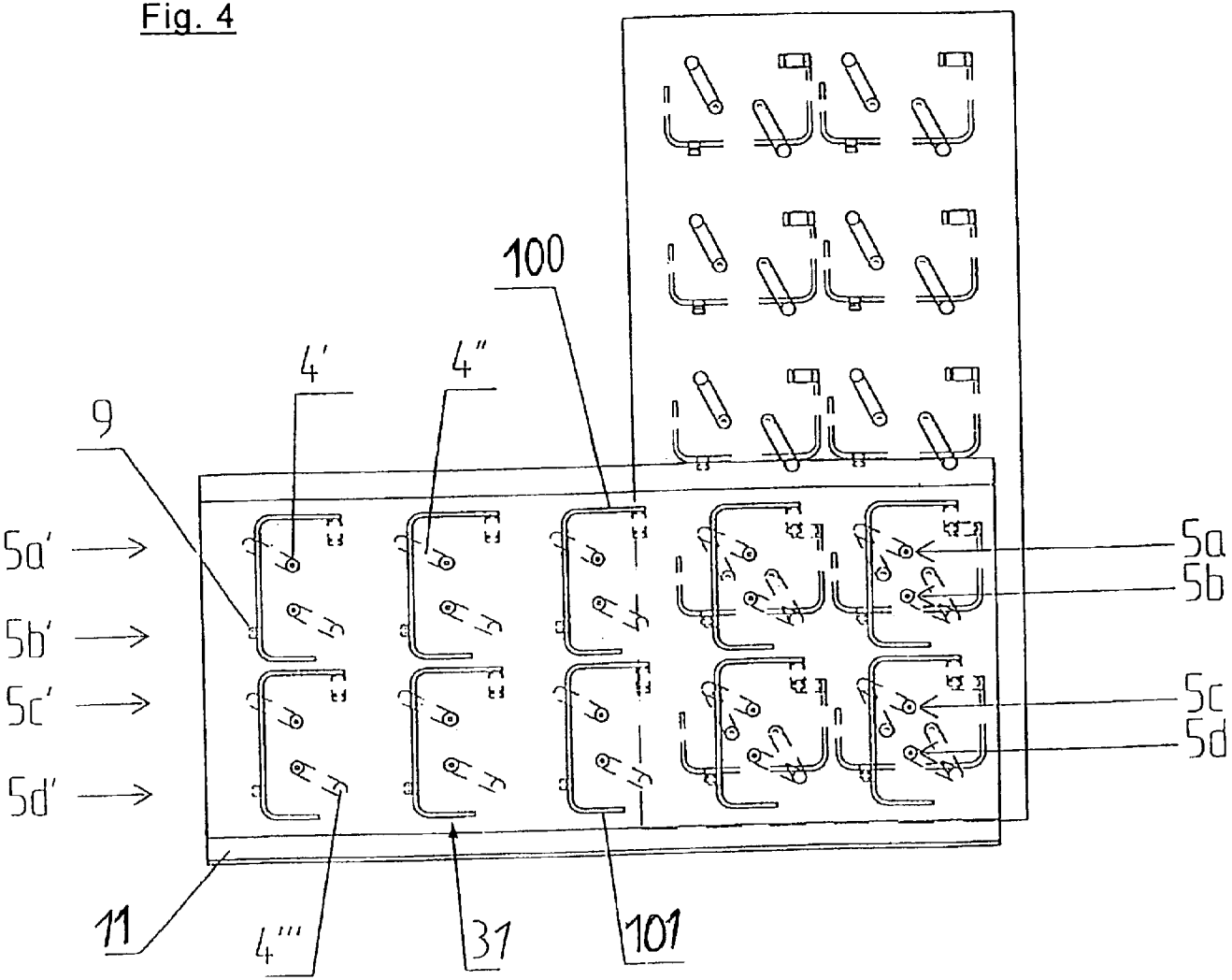
FIG. 4: shows a schematic diagram of two male multipoint connectors according to FIG. 3 in horizontal projection.

FIG. 4 illustrates a schematic projection of two male multipoint connectors 11 in the condition in which they are pushed onto a printed-circuit board 6, not illustrated here. In this case first portions 4' of contact elements 41 are arranged in four rows 5*a* to 5*d* respectively such that they are disposed in alignment with one another. Third portions 4''' of contact elements 41 are disposed in rows 5*a*' to 5*d*' offset relative thereto. Second portions 4'' run substantially perpendicular to the longitudinal extent of the respective first and third portions 4', 4''' in the plane of the drawing. As is evident from the diagram in FIG. 3, these second portions 4'' in this case project outwardly beyond bottom 8 of male multipoint connector 11, although they can also be disposed in recesses of bottom 8 or can already be potted in bottom 8 during manufacture.

The orientation of the offset or crank-shaped structure is chosen such that the corresponding two third portions 4''' of two adjacent rows, such as 5*a* and 5*b*, are offset from one another by some distance, so that the spacing of these third portions 4''' is greater than the spacing of the associated first portions 4'.

In this case second portions 4'' of a male multipoint connector 11 are preferably oriented such that they are all parallel to one another.

Guide pins 9 with square cross section are also present here. Contact elements 41, which in this case are the blades of male multipoint connector 11, but which can also be the sockets of a female multipoint connector, are arranged in such a way that their mutual spacings are equally large both in respective rows 5*a* to 5*d*—spacings "a"—and between rows 5*a* to 5*d*—spacings "b". In this way a square diagonal size "Q" of the contact elements is achieved.

According to the embodiment in FIG. 4, first portions 4' of contact elements 41 are embraced in pairs by a substantially U-shaped shield plate 31, whose limbs 100, 101 are oriented parallel to the longitudinal extent of rows 5*a* to 5*d*, limb 100 being longer than limb 101. In the horizontal projection it is therefore evident that shielding of the electrical contacting is achieved over the longitudinal extent of the electrical contacting between the two male multipoint connectors 1 in a way which indeed does not pass physically through printed-circuit board 6 but technically has the effect of a perimeter.

Figure 4B:
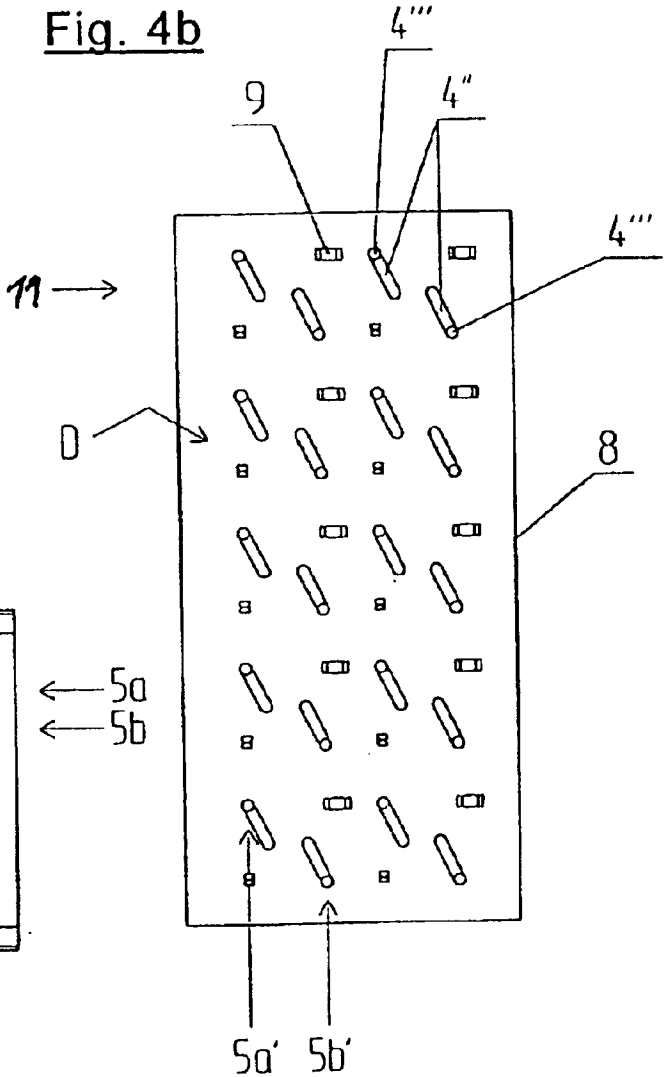
FIGS. 4*a* and 4*b*: show partial diagrams of FIG. 4.
Figure 4A:
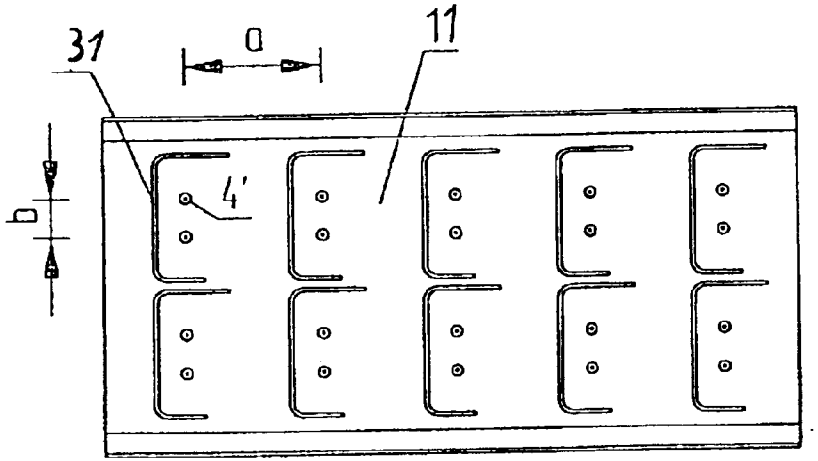

FIG. 4*a* shows a male multipoint connector 11 according to the diagram in FIG. 4, except that here shield plates 31 in this case respectively embrace two first portions 4' of the contact elements in pairs. Spacing "a" between two contact elements 41 in a row, such as 5*a*, is then greater than the mutual spacing "b" of two rows, such as between 5*a* and 5*b*.

In FIG. 4*b*, male multipoint connector 11 is shown as standing upright on its head. Therein outwardly pointing face "D" of bottom 8 is visible. In addition to third portions 4''', guide pins 9 are illustrated here. Just as third portions 4''', the respective second portions 4'' running perpendicular thereto also project beyond bottom face "D" of bottom 8. In this case second portions 4'' of all contact elements 41 are oriented parallel to one another. Third portions 4''' of two adjacent contact elements, such as those of rows 5*a*' and 5*b*', are then disposed offset relative to one another such that their mutual spacing is larger than the spacing of first portions 4', which are not illustrated here.

Thus, with a female multipoint connector of corresponding structure, inserted into the interior cavity formed in male multipoint connector 11 by bottom 8 and walls "A", "B", for example, there is also achieved continuous shielding of the electrical connection between contact elements 4, such as blades, and the contact elements on the female multipoint connector, such as sockets.

| List of reference symbols | |
|---|---|
| 1 | Male multipoint connector |
| 11 | Male multipoint connector |
| 3 | Shield plates |
| 31 | Shield plates |

-continued

| List of reference symbols | |
|---|---|
| 4 | Contact element |
| 4a . . . 4d | Pairs of contact elements |
| 41 | Contact element (crank-shaped) |
| 4', 4", 4'" | Portions of item 41 |
| 5a, 5b, 5c, 5d | Rows of contact elements |
| 5a', 5b', 5c', 5d' | Rows of third portions 4'" |
| 6 | Printed-circuit board |
| 7 | Bores in item 6 |
| 8 | Bottom of item 1 and item 11 |
| 9 | Guide pins |
| 10 | Limb of item 3 (long) |
| 10' | Limb of item 3 (short) |
| 100 | Limb of item 31 (long) |
| 101 | Limb of item 31 (short) |
| A, B | Wall of item 1 and item 11 |
| D | Outer face of item 8 |
| a | Spacing of the first portions in a row |
| b | Spacing of two adjacent rows |
| Q | Spacing relative to item 4 |

What is claimed is:

1. A plug connection with shielding, especially a multi-conductor, multi-row plug connection, comprising a male multipoint connector (1) and female multipoint connector, with at least two contact elements (4), which are shielded from the outside and from further contact elements (4) by shield plates (3), the shield plates (3) being disposed on the male multipoint connector (1) and female multipoint connector and each at least partly embracing at least two adjacent contact elements (4), and the contact elements (4) being disposed in the male multipoint connector (1) and female multipoint connector in a plurality of parallel rows **(5*a*, 5*b*, 5*c*, 5*d*), wherein at least two rows (5*a*, 5*b*, 5*c*, 5*d*) of the contact elements (4) are disposed offset relative to one another as viewed perpendicular to their longitudinal extent, and each shield plate (3) embraces at least one contact element (4)** from two adjacent rows disposed offset relative to one another.

2. A plug connector with shielding according to claim 1, wherein the contact elements of the first **(5*a*), third (5*c*) and corresponding further rows and those of the second (5*b*), fourth (5*d*)** and corresponding further rows are respectively disposed in alignment with one another as viewed perpendicular to their longitudinal extent.

3. A plug connection with shielding according to claim 1, wherein an even number of rows **(5*a* . . . 5*d*)**, especially four, is present.

4. A plug connection with shielding according to claim 1, wherein the shield plates (3) are disposed at an angle of 45° to the longitudinal extent of the male multipoint connector (1) and female multipoint connector.

5. A plug connection with shielding according to claim 1, wherein the shield plates (3) are substantially U-shaped.

6. A plug connection with shielding according to claim 1, wherein the shield plates (3) pass through the bottom (8) of the male multipoint connector (1) or of the female multipoint connector.

7. A plug connection with shielding according to claim 1, wherein outwardly projecting guide pins (9) are provided on the bottom (8) of the male multipoint connector (1) or of the female multipoint connector.

8. A plug connection with shielding, especially a multi-conductor, multi-row plug connection, comprising a male multipoint connector (11) and female multipoint connector, with at least two contact elements (41), which are shielded from the outside and from further contact elements (41) by shield plates (31), the shield plates (31) being disposed on the male multipoint connector (11) and female multipoint connector and each at least partly embracing at least two adjacent contact elements (41), and the contact elements (41) being disposed in the male multipoint connector (11) and female multipoint connector in a plurality of parallel rows **(5*a*, 5*b*, 5*c*, 5*d*), wherein the contact elements (41) have a substantially Z-shaped cranked structure formed by three portions (4', 4", 4'"), the first portions (4') are disposed in rows (5*a* to 5*d*), which are in alignment with one another as viewed perpendicular to the longitudinal extent of the rows (5*a* to 5*d*), and the third portions (4'") are disposed offset relative to one another at least in two rows (5*a*' to 5*d*'), as viewed perpendicular to the longitudinal extent of the rows (5*a*' to 5*d*'), and each shield plate (31) embraces at least two first portions (4') of contact elements (4) from two adjacent rows (5*a* to 5*d*)**.

9. A plug connection with shielding according to claim 8, wherein the shield plates (31) are substantially U-shaped, and embrace two first portions (4') of contract elements (41).

10. A plug connection with shielding according to claim 8, wherein the third portions (4'") of the contact elements (41), viewed in a horizontal projection relative to the longitudinal extent of the rows **(5*a* to 5*d* and 5*a*' to 5*d*'), are disposed offset relative to the first portions (4') of the contact elements (41)**.

11. A plug connection with shielding according to claim 8, wherein the second portions (4") run substantially perpendicular to the longitudinal extent of the first and third portions (4' and 4'"), and in particular all second portions (4") of a male multipoint connector (11) are parallel to one another.

* * * * *